US007200944B2

(12) United States Patent
Rager

(10) Patent No.: US 7,200,944 B2
(45) **Date of Patent: *Apr. 10, 2007**

(54) PENDULUM BOW SIGHT

(75) Inventor: Christopher A. Rager, Bozeman, MT (US)

(73) Assignee: Trophy Ridge, LLC, Belgrade, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/095,041

(22) Filed: Mar. 31, 2005

(65) Prior Publication Data

US 2005/0246909 A1 Nov. 10, 2005

Related U.S. Application Data

(63) Continuation-in-part of application No. 10/661,918, filed on Sep. 12, 2003, now Pat. No. 7,000,327.

(60) Provisional application No. 60/410,877, filed on Sep. 13, 2002.

(51) Int. Cl.
*F41G 1/00* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | |
|---|---|---|---|
| 3,234,651 | A | 2/1966 | Rivers |
| 4,120,096 | A | 10/1978 | Keller |
| 4,580,349 | A | 4/1986 | Webb et al. |
| 4,616,422 | A | 10/1986 | Gaddy |
| 4,711,036 | A | 12/1987 | Morris |
| 4,720,919 | A | 1/1988 | Saunders |
| 4,796,364 | A | 1/1989 | Amacker |
| 4,846,141 | A | 7/1989 | Johnson |
| 4,884,347 | A | 12/1989 | Larson |
| 4,967,478 | A | 11/1990 | Sherman |
| 5,086,567 | A | 2/1992 | Tutsch |
| 5,103,568 | A | 4/1992 | Canoy |
| 5,121,547 | A | 6/1992 | Littlejohn |
| 5,131,153 | A | 7/1992 | Seales |
| 5,253,423 | A | 10/1993 | Sullivan, Jr. et al. |
| 5,303,479 | A | 4/1994 | Rudovsky |
| 5,305,530 | A | 4/1994 | Robertson, Jr. et al. |
| 5,383,279 | A | 1/1995 | Tami |
| 5,388,336 | A | 2/1995 | Pomaville |
| 5,419,051 | A | 5/1995 | Barngrover |
| 5,465,491 | A | 11/1995 | Thell |
| 5,539,989 | A | 7/1996 | Potter |
| 5,560,113 | A | 10/1996 | Simo et al. |
| 5,634,278 | A | 6/1997 | London |
| 5,676,122 | A | 10/1997 | Wiseby et al. |
| 5,685,081 | A | 11/1997 | Winegar |
| 5,914,775 | A | 6/1999 | Hargrove et al. |
| 6,079,111 | A * | 6/2000 | Williams et al. ..... 33/265 |
| 6,145,208 | A | 11/2000 | Savage |

(Continued)

*Primary Examiner*—Diego Gutierrez
*Assistant Examiner*—Tania Courson
(74) *Attorney, Agent, or Firm*—Merchant & Gould P.C.

(57) ABSTRACT

One aspect of the present disclosure relates to a method of targeting. The method includes positioning a sight point so that the sight point can be used to shoot targets located at different positions relative to the shooter. Another aspect of the present disclosure relates to a sighting arrangement for facilitating the practice of the above-identified method.

22 Claims, 6 Drawing Sheets

U.S. PATENT DOCUMENTS 6,199,286 B1 3/2001 Reed, Jr. et al.
6,418,632 B1 7/2002 Kalfayan
6,418,633 B1 7/2002 Rager
6,430,821 B1 8/2002 Cionni
6,560,884 B1 5/2003 Afshari
6,651,350 B1 * 11/2003 Manns et al. ..... 33/265
6,725,854 B1 4/2004 Afshari
7,000,327 B2 * 2/2006 Rager ..... 33/265
7,036,234 B2 * 5/2006 Rager ..... 33/265
2004/0006879 A1 1/2004 Afshari
2004/0088871 A1 5/2004 Afshari

* cited by examiner

FIG. 7
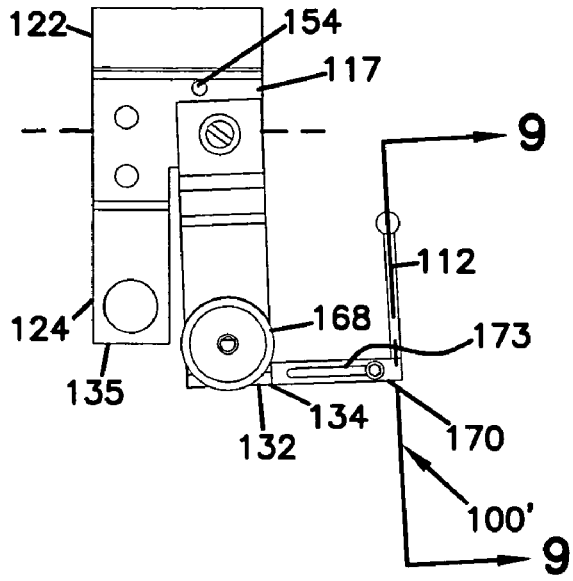
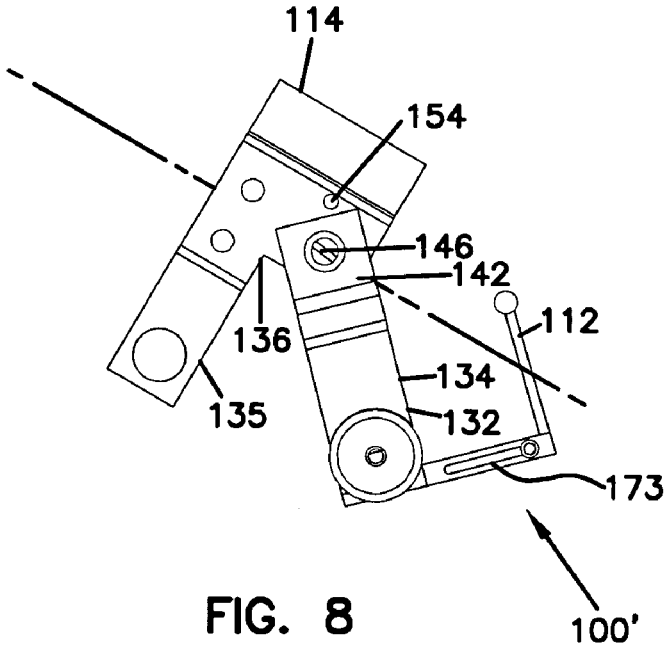
FIG. 8

PENDULUM BOW SIGHT

CROSS REFERENCE TO RELATED APPLICATION

This application is a continuation-in-part of application Ser. No. 10/661,918 filed Sep. 12, 2003, which issued as U.S. Pat. No. 7,000,327 on Feb. 21, 2006, which application claims the benefit of provisional application Ser. No. 60/410,877 filed Sep. 13, 2002, both of which are incorporated herein by reference in their entireties.

FIELD OF THE INVENTION

This invention relates to archery equipment and more particularly to a sighting apparatus for use with an archery bow, generally referred to as a bow sight. In particular, the bow sight of this invention provides vertical sighting compensation.

BACKGROUND OF THE INVENTION

Many bow sight designs and configurations are known. Bow sights generally have multiple sight points for shooting arrows at targets positioned at different distances from the archer. Many bow sights include multiple sight points attached to horizontal pins; examples of such bow sights are shown, for example, in U.S. Pat. Nos. 5,103,568; 5,676,122; and 5,685,081. A more recent development has been a bow sight with vertical pins. An example of a bow sight having vertical pins and a fiber optic sight point at the end of the pins is shown, for example, in U.S. Pat. No. 6,418,633. A number of U.S. patents disclose bow sights having various other arrangements of sight points. See, for example, U.S. Pat. Nos. 3,234,651; 4,120,096; 5,086,567; and 5,131,153.

Bow sights have typically been designed to provide accurate sighting over changing distances where the elevation difference between the target and the shooter remains relatively constant. In other words, the position of each sight point is adjusted to effectively target an object at a set distance measured from the shooter while the vertical displacement, or elevation, between the shooter and the target is assumed to be constant. As such, if a bow having sight points adjusted to be accurate over level ground is used to shoot at a target located either above or below the shooter, the resulting shot will be off target. For example, if the target is below the shooter, the sight will overcompensate for the arrow drop due to gravity and the shot will be too high.

To ensure accuracy, traditional sight points require recalibration and manual readjustment whenever the relative elevation difference between the shooter and the target is varied. Pendulum style bow sites have been developed that automatically adjust to maintain accuracy when the bow is used to shoot targets located at different elevations relative to the shooter. See, for example, U.S. Pat. Nos. 6,145,208; 5,253,423; and 5,121,547; see also U.S. patent application Ser. No. 10/661,918 filed Sep. 12, 2003, which is incorporated herein by reference. Nonetheless, the current sights in this field can be improved with respect to their accuracy, ease of use, reliability, and simplicity.

SUMMARY OF THE INVENTION

One aspect of the present disclosure relates to a method of targeting. The method includes positioning a sight point so that the sight point can be used to shoot targets located at different positions relative to the shooter. Another aspect of the present disclosure relates to a sighting arrangement for facilitating the practice of the above-identified method.

BRIEF DESCRIPTION OF THE DRAWINGS

FIG. 7 is a side view of the alternative embodiment of FIG. 5 in an unpivoted position;

FIG. 8 is a side view of the alternative embodiment of FIG. 5 in a pivoted position.

DETAILED DESCRIPTION OF THE PREFERRED EMBODIMENT

In the following description of the preferred embodiment, reference is made to the accompanying drawings, which form a part hereof, and in which is shown, by way of illustration, specific embodiments in which the invention may be practiced. It is to be understood that other embodiments may be utilized and structural changes may be made without departing from the scope of the present invention.

Figure 1:
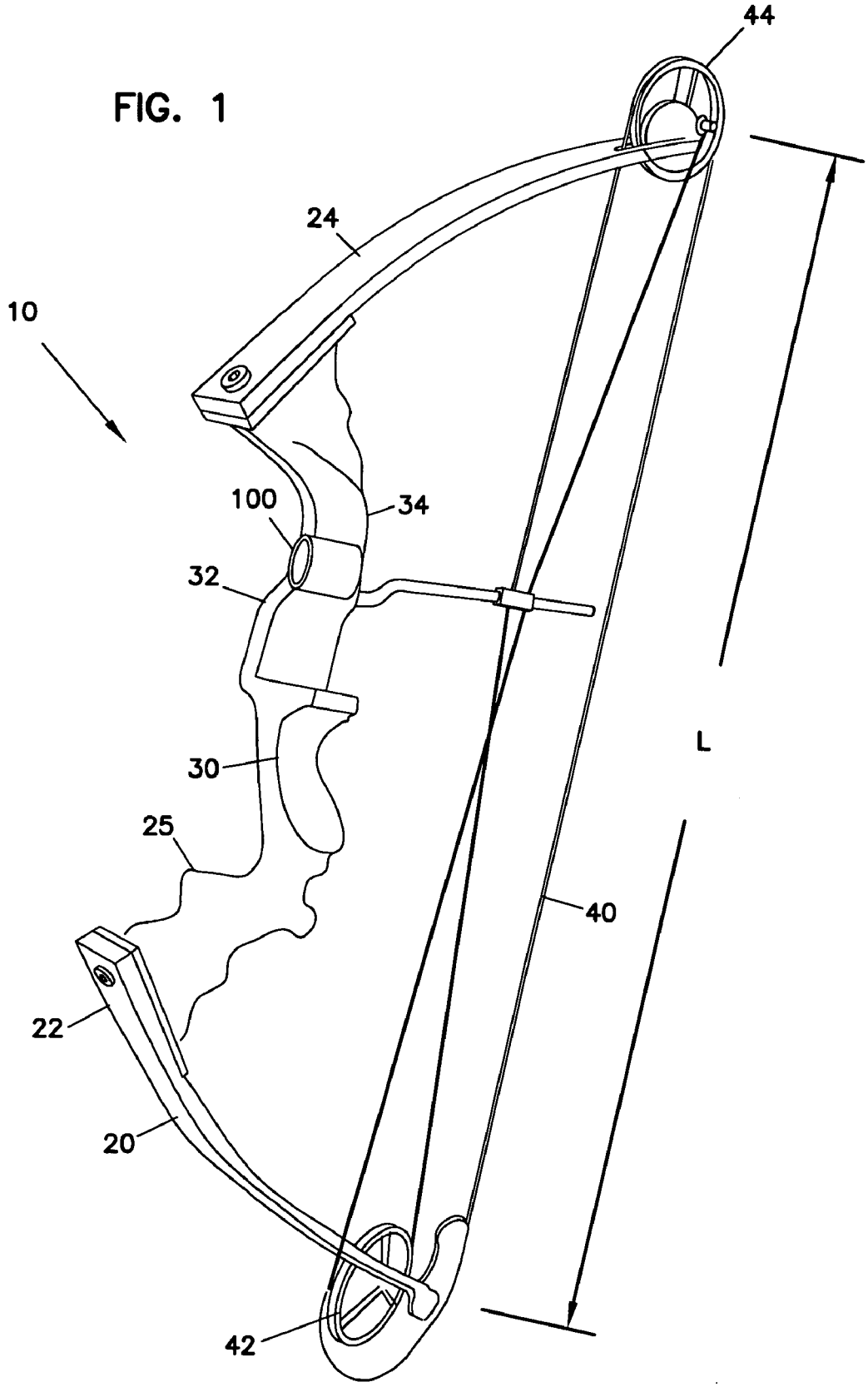
FIG. 1 is a is a perspective view of a bow incorporating a bow sight.

Referring now to the figures, wherein like features are referenced with like numerals, a bow 10 is shown in FIG. 1. Bow 10 has a frame 20 and a grip 30. Frame 20 includes a lower portion or arm 22, an upper portion or arm 24, and a handle portion 25 with a grip 30 connected to and supporting lower arm 22 and upper arm 24. Handle 25 has a front surface 32 and an opposite back surface 34. During shooting with the bow, front surface 32 is positioned facing the target and back surface 34 is facing the archer.

Bow 10 is illustrated as a compound bow, with pulley or cam 42 at the end of lower arm 22 and pulley or cam 44 at the end of upper arm 24. A bowstring 40 extends along the length L of the bow 10 between cam 42 and cam 44. Cams 42, 44 provide a mechanical advantage to the archer when drawing bowstring 40. As shown, a peep sight 46 may be positioned on bowstring 40 to facilitate targeting and aiming.

Mounted on handle 25 of bow 10 is a bow sight 100, which facilitates targeting; that is, bow sight 100 includes a device that can be calibrated to be used to situate the bow so that it accurately shoots arrows at targets position at particular distances and/or directions from the shooter.

Figure 2:
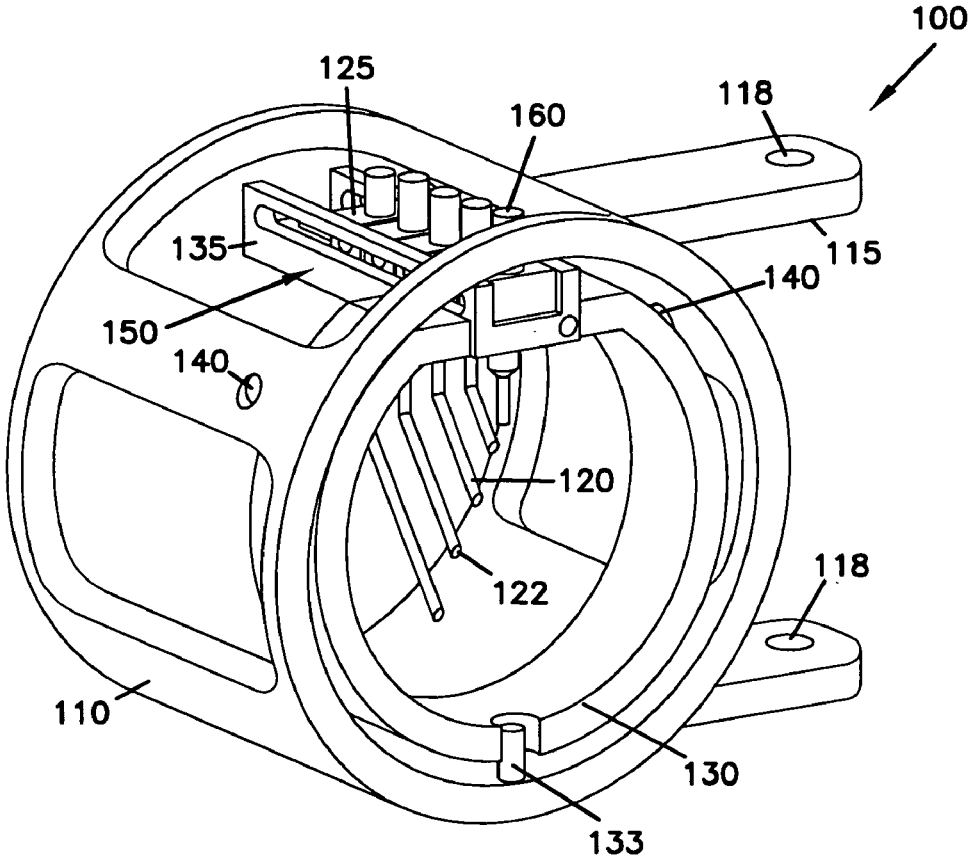
FIG. 2 is a perspective view of a bow sight according to the present invention.
Figure 3:
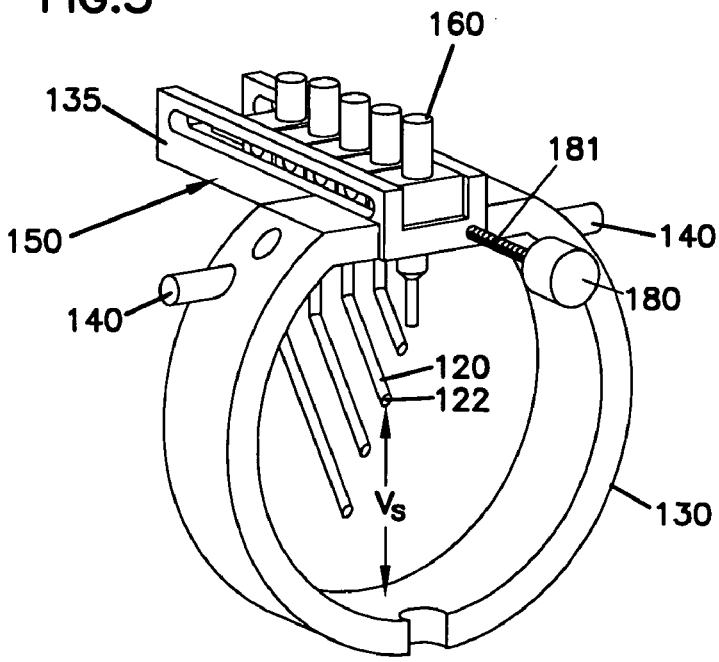
FIG. 3 is a perspective view of a portion of the bow sight of FIG. 2.

Referring to FIGS. 2 and 3 an embodiment of a bow sight is illustrated as bow sight 100. For purposes of this application, the view of the bow sight as seen from the archer in the shooting position, which is the view illustrated in FIG. 2, is referred to as the "front view" of the bow sight. When the bow sight is mounted on a bow and held in a shooting position, the direction perpendicular to the ground is the upward or downward direction. When the bow sight is mounted on a bow and held in a shooting position, the direction perpendicular to an imaginary line that runs from the shooter's eye through the sight point 122 to the target that is in a direction that extends generally along the length L of the bow 10 is referred to herein as the transverse height direction. Accordingly, the upward and downward directions are relative to the ground whereas the transverse height direction is relative to the shooters line of sight.

Figure 4:
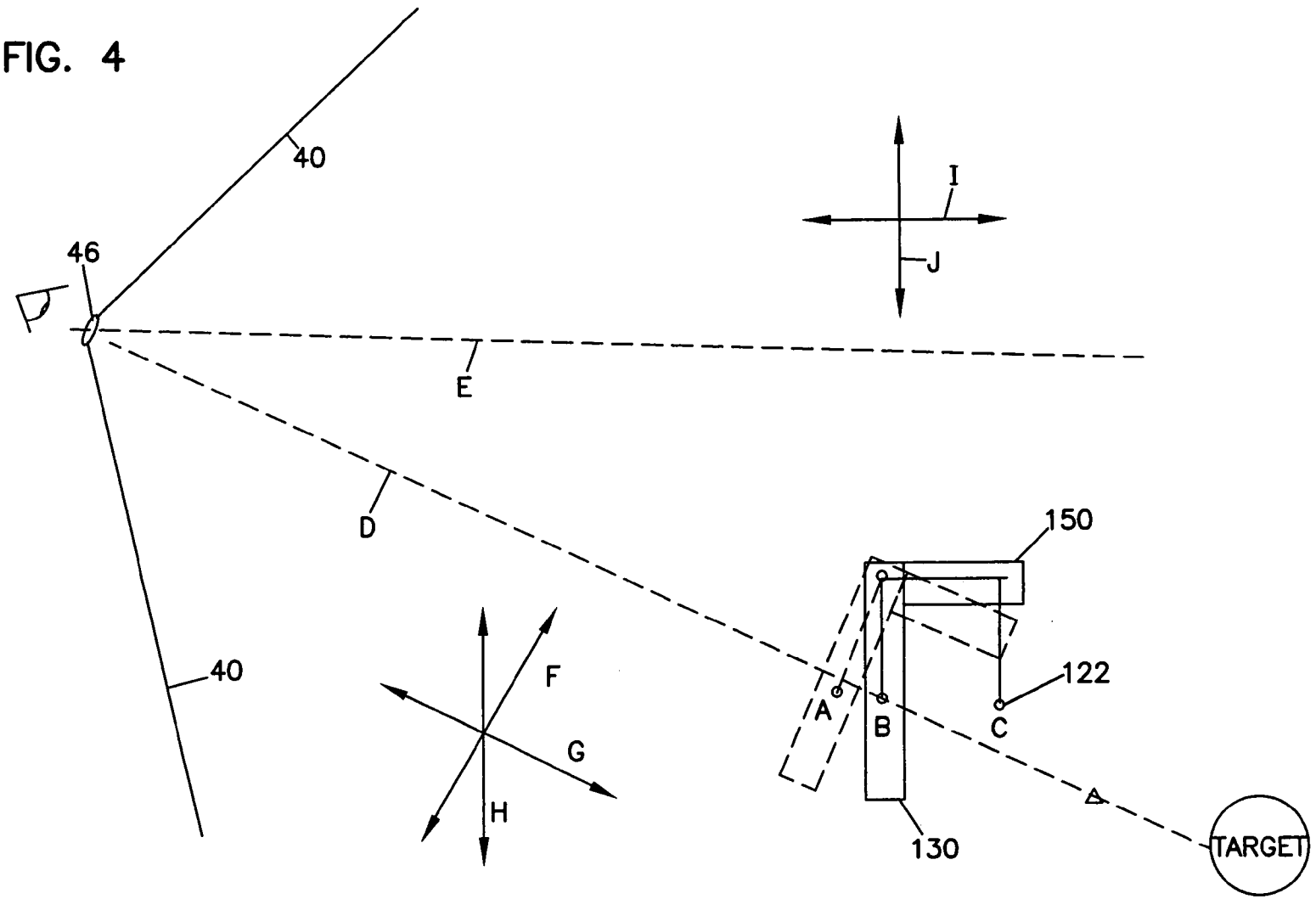
FIG. 4 is a schematic representation of sight pins for illustrating the position of the sight pins when the bow is aimed downwards.

Referring to FIG. 4, it should be understood that when the bow sight 100 is mounted to a bow 10 and the bow 10 is position for shooting at a target located at the same elevation as the bow 10, the sight line that extends between the peep sight 46 and the sight point 122 is orientated in a neutral angle relative to a horizontal plane E (i.e., the sight line is horizontal). On the other hand, if the bow 10 is positioned for shooting at a target located at a lower elevation with respect to the bow 10 (i.e., aimed downward), the sight line D that extends between the shooter's eye and the target through the peep sight 46 and the sight point 122 is orientated at a negative angle (i.e., downward angle) with respect to a horizontal plane. With respect to the sight line D, the transverse height direction is marked with the letter F, the direction towards and away from the target is marked with the letter G, and the direction generally upward and downward is marked with the letter H. With respect to the sight line E, the transverse height direction is marked with the letter J, the direction towards and away from the target is marked with the letter I, and the direction generally upward and downward is also marked with the letter J.

To shoot the bow, the archer draws the string 40 and then peers through the peep sight 46 to locate the target. The archer precisely aims the bow 10 by establishing a sight line that extends from the peep sight 46 through the sight point 122 to the target. Once the peep sight 46, the sight point 122, and the target are all aligned, the string 40 is released to shoot the arrow at the target. When shooting from elevations higher than the target (e.g., a tree stand), the pendulum effect of the bow sight 100 moves the sight point 122 upwardly in the transverse height direction F as compared to a pin that does not pivot so that the arrow shoots lower to compensate for the downward angle of the sight line. As shown in FIG. 4, position A is the position in which the sight point 122 would be located if the sight point 122 did not pivot. Position B is the position in which the sight point 122 would be located if the sight point 122 pivots. As illustrated, position A is relatively lower in the vertical direction F than position B with respect to the peep sight 46.

According to the present disclosure, the sight point 122 can set at a particular location toward or away from the target shooter. When the sight point is adjusted away from the shooter and towards the target, the sight point 122 is moved further upward in the transverse height direction when the bow 10 is aimed downward. As illustrated, the sight point 122 in position C, which is adjusted away from the shooter and towards the target, is relatively higher than the sight point in position B. It should be understood that the method could also be practiced without using a peep sight 46. In some embodiments, the shooter is trained to shoot accurately without relying on any type of rear sight. In other embodiments a rear sight is attached to the frame of the bow 10 rather than the bowstring 40.

Referring back to FIGS. 2 and 3, bow sight 100 generally includes a stationary portion adapted to be fixedly mounted to bow handle 25 and a second portion (i.e., a pendulum member) pivotally mounted to the stationary portion. Bow sight 100 is shown to include a housing or support structure 110 for mounting bow sight 100 to bow handle 25. Extending from structure 110 are brackets 115 having apertures 118 therein, for mounting bow sight 100 to bow handle 25 with screws or other attachment means. In a preferred embodiment, support structure 110 is a generally circular shaped piece of material, such as acrylic, polycarbonate, or other plastic, aluminum, or the like. Other examples of suitable support structure shapes include, for example, square, elliptical, and oblong. Housing support structure 110 may be composed of multiple sections or pieces that together form the support structure. Housing support 110 may be solid, or may include various perforations or apertures, to lighten bow sight 100, to facilitate movement of various parts of bow sight 100, or to allow more light to enter bow sight 100.

Pivotally attached to housing support structure 110 is a plurality of sight pins 120, each pin 120 defining a sight point 122. In the embodiment illustrated, sight pins 120 are movably attached to a sight window 130, which is pivotally attached to support structure 110 at pivot axis 140. Pivot axis 140 extends generally horizontal to the ground and perpendicular to bow handle 25, so that pivoting of sight window 130 around pivot axis 140 produces swinging movement of sight window 130 away from support structure 110 and the archer in a pendulum-like manner. It is preferred that sight window 130 encompasses and encircles pins 120 at least partially, so that pins 120 are positioned within sight window 130. Similarly, it is preferred that support structure 110 encompasses and encircles sight window 130 at least partially. Housing support 110 and sight window 130 are shaped and sized so that sight window 130 can pivot within support structure 110 around pivot axis 140. A stop may be positioned on housing 110, on window 130, or both, to inhibit the movement of window 130 in relation to support 110. In the embodiment illustrated, a bumper stop 133 extends from housing support structure 110 to limit window 130 from swinging forward of support structure 110. Window 130 includes a notch to accept stop 133.

It should be understood that the sight window 130 can be constructed such that it tends to pivot away from the support structure 110 whenever the bow 10 is orientated such that the sight line that extends between the peep sight 46 and the sight point 122 is orientated at a negative angle (i.e., downward angle) with respect to a horizontal plane. One way to accomplish the above object is to construct the sight window 130 such that it is substantially balanced about the pivot axis 140. Such a construction can, for example, include incorporating a counter weight 180 on the sight window 130. In the embodiment shown in FIG. 3, the counter weight 180 is shown to included a threaded end 181 to enable adjusting the distance that it projects from the sight window 130. Other construction methods for balancing the sight window are also possible, for example, using lightweight materials to construct the portion of the sight window 130 that projects away from the pivot axis 140 (e.g., the slider 125 and slider casting 135), and/or offsetting the pivot axis 140 towards the back side of the bow sight 100.

Figure 9:
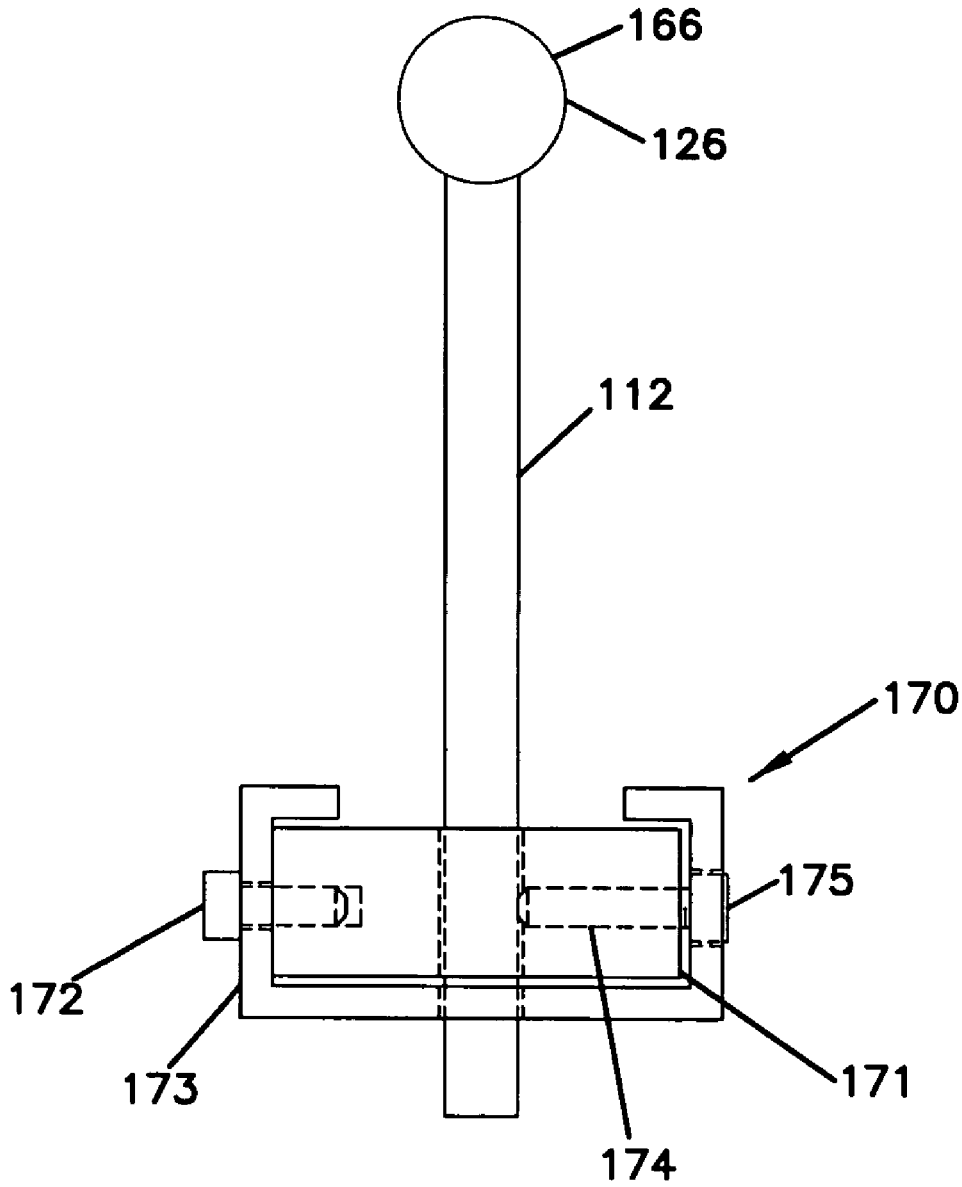
FIG. 9 is a cross-sectional view of the alternative embodiment of FIG. 5 along line A—A.

Sight pins 120 support or otherwise define sight points 122, which the archer uses for targeting an object. Sight point 122 may be integral with pins 120 or be a separate piece from pins 120. A sight or sighting point is any shape, point, or indicia of any sort that is visually placed in line with the target to be shot at for assisting in the proper aiming of the bow. Sight points 122 can be circular shapes, other geometrical shapes, colored dots, painted dots, the end of a light gathering cable, or simply the end of sight pins 120, for example. Although five pins 120 and their respective sight points 122 are illustrated in the figures, it is understood that any number of pins 120 and sight points 122 can be utilized; in most embodiments, however, at least one pins 120 will be present. Pins may be straight as shown in FIGS. 9 and 10 or may be bent as shown in FIGS. 2 and 3.

In a preferred embodiment, sight pin 120 is a pin constructed to support a sight point 122. An end of a fiber optic cable may be positioned at the end of sight pin 120 to act as sight point 122. The fiber optic cable collects light along its length, and the light exits the end of the cable forming sight point 122. The fiber optic cable may be held in place by a slit or other aperture located near the end of pin 120. Since the fiber optic cable collects light along its length, sight points 122 that are associated with long fiber optic cables that are exposed to light are brighter than sight points 122 that are associated with short fiber optic cables that are not exposed to light. As such, in some embodiments the sight points 122 are associated fiber optic cables that are coiled around the structure of the bow sight 100 that is exposed to light, for example, the fiber optic cable 166 (shown in FIG. 8) can be coiled around the hub 168.

The preferred pins 120 for use with bow sight 100 are vertical pins, or, pins that have a vertical component so that at least a portion of the pin extends in a vertical direction. As used herein, a pin is considered a vertical pin if the pin has a vertical portion (i.e., a portion aligned in a vertical plane). Additionally, in a preferred embodiment, multiple pins are positioned so that they are aligned when viewed by the archer in the shooting position. The benefit of vertical aligned pins is discussed, for example, in U.S. Pat. No. 6,418,633, which is incorporated herein by reference. Preferably, when multiple vertical pins are aligned, the archer is able to view the sight point of each pin, but only views the widest pin. Though only vertical pins are shown in the figures, non-vertical pin arrangements in accordance with the present disclosure are also possible. For example, the pins can be horizontal meaning, when viewed by the archer in the shooting position, pins 120 extend from the left or right side of support housing 110 into the field of view. In such an embodiment, the horizontal pins can be housed in vertical slots to allow for vertical adjustment and the vertical slots can be slidably engaged with horizontal slots to allow for front to back adjustment of the pins without effecting the vertical position of the pins.

As stated above, pins 120 are preferably movably attached to sight window 130, although in some embodiments, the entire pin 120 is not moveable and only the sight points 122 are moveable in relation to sight window 130. In the embodiment illustrated in FIGS. 2 and 3, pins 120 are held by structure 150. Structure 150 includes various features that provide for vertical and front to back (horizontal) adjustment of sight points 122 of pins 120. In the embodiment shown in FIG. 3, the vertical adjustment determines the distance Vs shown as the distance between the sight point 122 and the bottom or lower portion of the sight window 130.

Still referring to FIGS. 2 and 3, front to back, adjustment is accomplished via a configuration that moves sight points 122 towards or away from the target. One embodiment for a front to back adjustment configuration includes sliders 125 housed within a slider casing 135. Sliders 125 and casing 135 allow front to back adjustment of pins 120 in relation to sight window 130; that is, sliders 125 and casing 135 allow pins 120 to be moved farther from and closer to the archer. Each pin 120 is attached to a slider 125, which is movable within slider casing 135. A set screw, locking cam, or other such mechanism can be used to move and lock slider 125 and pin 120 in relation to casing 135. Access to the locking mechanism can be gained through a slot or other structure in casing 135. That is, the front to back position of sight point 122 is adjusted so that the sight point 122 corresponds to a set target distance (for example, 20 yards) whether shooting flat or angled.

To use bow sight 100, an archer would first mount bow sight 100 onto bow handle 25 via mounting brackets 115. The shortest yardage pin (typically a 20 yard pin) is moved up or down in the transverse height direction to provide accurate targeting when the sight point 122 is aligned with a target at roughly the same elevation as the shooter. Sight window 130 can be locked in relation to housing support structure 110 for convenience while making this adjustment. After positioning sight point 122 while on flat ground, the transverse height position of pin 120 need not be loosened or adjusted again. Once positioned, any locking mechanism is unlocked so that sight window 130 is free to pivot around axis 140 in relation to support structure 110 and bow handle 25.

The bow sight is then targeted on an object positioned on a slope, typically a downward slope. A downward slope of 30 to 45 degrees is typical for shooting from a tree stand. Angling the bow 10 down will cause sight window 130 to swing down and away from the archer. To target the bow on a slope, the sight point 122 is adjusted by moving the sight pin 120 towards or away from a target using slider 125 in casing 135, while maintaining the verse height position of the sight point 122. In other words, in the illustrated embodiment, the verse height position of sight point 122 relative to the sight window 130 does not changed when the sight point is moved towards or away from the target. In the illustrated embodiment, the entire pin 120 moves forward or backwards relative to the sight window 130.

It should be appreciated that numerous other front to back adjustment configurations are possible according to the disclosure. For example, in some embodiments slider 125 includes a discrete number of front to back locations that are constructed to receive or interlock with the pin 120 once it is adjusted in the transverse height direction. In other embodiments the slider includes a high friction material such as rubber that interfaces with the pins so that the pins can be adjusted by simply pushing them back and forth, yet they stay in place during ordinary use once initially set. In other embodiments the pins can include a spring loaded securing arrangement that holds the pins in place unless the shooter depresses the spring for adjustment. In should also be appreciated that in alternative embodiments, the sight point 122 need not be sighted in for one horizontal shot and one sloped or angled shot. For example, the sight point 122 can be sighted in for two different sloped or angled shots.

Transverse height adjustment of sight points 122 is accomplished via transverse height adjustment mechanism 160; in a preferred embodiment, transverse height adjustment of sight point 122 is accomplished by transverse height adjustment of pins 120. Transverse height adjustment mechanism 160 can be any structure that allows movement of and then locks sight point 122 in relation to structure 150. Examples of suitable mechanism 160 include setscrews, geared cams, worm gears, locking cams, and threads on the pins. Example gear and cam arrangements are disclosed in U.S. Pat. No. 6,418,633, which was previously incorporated herein by reference. In other embodiments, the transverse height position of the sight points 122 can be achieved by moving the entire sight up or down relative to the bow handle. In embodiments where the vertical adjustment mechanism includes cams or gears, the cams or gears can be arranged such that they can be moved towards and away from the shooter to allow for front to back adjustment of the sight pins. One such arrangement would include mounting the cams or gears on a slide or track.

Referring to FIGS. 5–9, an alternative embodiment of the sight according to the invention is shown. The bow sight 100' includes a frame 110' that defines a target viewing opening 116 through which a target can be viewed to visually frame the target for sighting. The frame 110' includes a first frame member 114 including a front portion defining a full ring 120, and a rear portion defining an upper partial ring 121. The frame 110' also includes a second frame member 134 in the form of a lower partial ring 132 pivotally connected to the upper partial ring 121 of the first frame member 114. The upper partial ring 121 cooperates with the lower partial ring 132 to form a substantially full ring that substantially circles the target viewing opening 116. The bow sight 100' also includes a sight pin 112 carried by the lower partial ring 132. The lower partial ring 132 is adapted to swing or pivot relative to the first frame member 114 in a pendulum-like manner when the bow sight 100' is moved from a horizontal sight line to a downwardly angled sight line. As discussed above, this pivoting action functions to raise a sight point 126 of the sight pin 112 as the bow 10 is aimed downwardly to compensate for the downward angle of the bow 10 which otherwise can cause archers to shoot above their intended target location.

The target viewing window opening 116 is relatively open so as to provide a relatively large and clear field of vision to facilitate aligning the target relative to the sight point 126. The target viewing opening 116 in some embodiments is unobstructed such that it includes no structures therein that are not constructed to be visually helpful in properly aligning the sight point 126 with the target. Unobstructed sight windows may, nonetheless, include the shaft 128 of a sight pin 112 and other structures for facilitating aiming a bow 10 such as a level 133.

In the embodiment shown, the frame 110' defines a generally circular and visually continuous target viewing opening 116. In addition, the frame 110' and the target viewing opening 116 include a ratio of the maximum width of the frame 110' (Fmax) to the maximum width of the target viewing opening 116 (Smax) that is no more than 1.5. With such a ratio the frame 110' and the target viewing opening 116 are relatively close in size. In the embodiment shown, the frame surrounds the sight point 126 to protect it from external impact.

As shown in FIGS. 7–9, the first frame member 114 defines a notched out back portion 136 that is shaped to nest the lower partial ring 132. The lower partial ring 132 is pivotally attached below the partial ring 121 of the first frame member 114 and behind a front lower portion 135 of the first frame member 114. The lower partial ring 132 is oriented behind the first frame member 114 such that at least a portion of the lower partial ring 132 is hidden from a front view when an archer peers through the target viewing opening 116 from the front side of the bow sight 100'. In other words, the arrangement of the frame member 114 and the lower partial ring 132 can be coaxial, which provides a visually clean low profile appearance. In certain embodiments a majority or substantially all of the ring 132 is hidden behind the first frame member 114 at least when the bow sight 100' is sighted along a horizontal sight line. Such an arrangement avoids obstructing the target viewing opening 116. Also, in the embodiment shown, the notched out back portion 136 is sized such that the back surface 117 of the bow sight 100' is in a single vertical plane when the sight 100' is sighted along a horizontal sight line.

The second frame member 134 can be U-shaped in that it includes two opposed connected arms 142. In the embodiments shown, the arms 142 define a generally semi-circular shape. The arms 142 are positioned to straddle the exterior of the upper partial ring 121. The two arms 142 can include pivot pins 146, such as screw, for attachment of the second frame member 134 to the upper partial ring 121. The pivot pins 146 define a pivot axis PA of the second frame member 134. The pivot axis PA preferably is oriented to intersect the target viewing opening 116. However, as discussed above, it is preferred for the target viewing opening 116 to be substantially free of obstructions. Therefore, while the pivot axis PA intersects the target viewing opening 116, it is preferred that no portion of the pivot pins 146 substantially projects into or across the target viewing opening 116.

The support frame 110' can also include one or more stops 154, which limit the range of motion of the second frame member 134 relative to the first frame member 114. In the embodiment shown, the stops are shown as bosses. In addition to the stops 154, the bow sight 100' includes a locking mechanism for limiting the range of pivotal movement of the second frame member 134 relative to the first frame member 114, and for selectively locking the second frame member 134 in the position of FIG. 5. Though possible, the locking mechanism 160 need not totally prevent the sight pin 112 from moving relative to the support frame 110'. The locking mechanism can include a fastener such as a set screw that threads downwardly through a vertical tapped hole defined by the upper partial ring 121. The tapped hole passes through a downwardly facing surface 138 of the upper partial ring 121. The downwardly facing surface 138 opposes an upwardly facing surface 152 defined by a shoulder of the lower partial ring 132. The downwardly facing lower surface 138 is radiused to prevent interference with the pivoting motion of the lower partial ring 132.

Referring to FIGS. 5–9, the sight pin 112 and sight point 126, which the archer uses for targeting an object, are shown. Sight point 126 may be integral with sight pin 112 or be a separate piece from the sight pins 112. Sight points 126 can be circular shapes, other geometrical shapes, colored dots, reflective structures, the end of an optical fiber 166 or other light emitting structures, or simply the end of sight pin 112.

Figure 5:
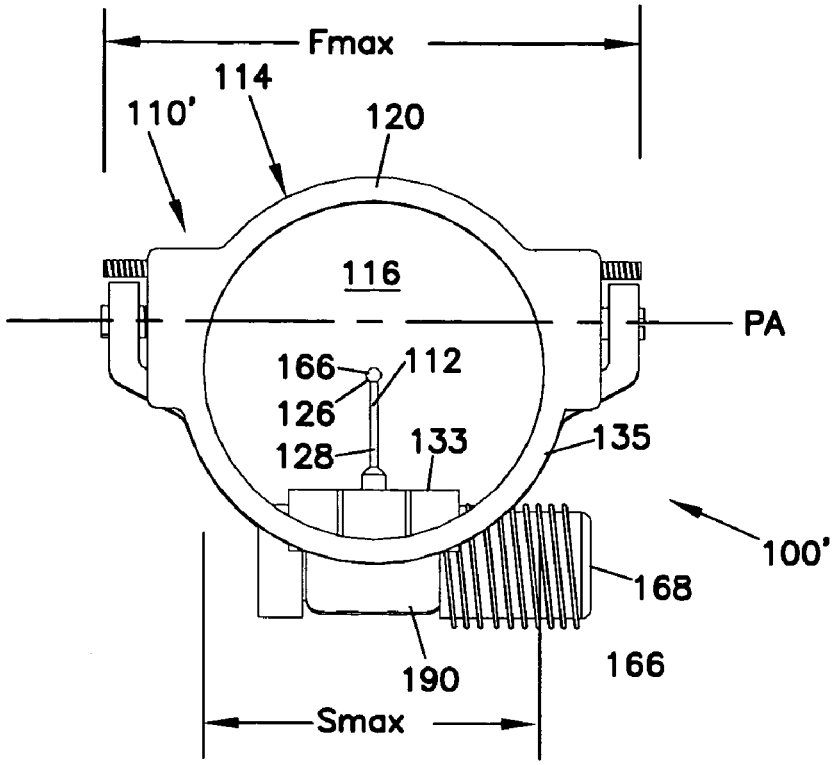
FIG. 5 is a front view of an alternative embodiment of a bow sight according to the present invention.
Figure 6:
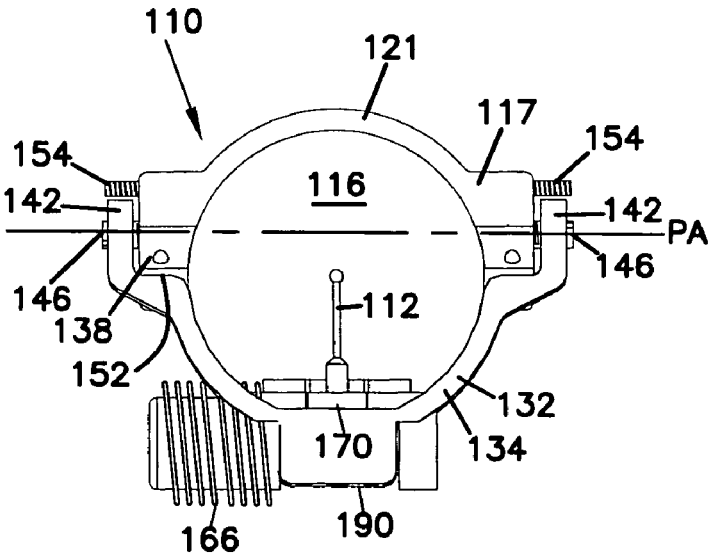
FIG. 6 is a back view of the alternative embodiment of FIG. 5.

The sight point 126 is preferably an optical sight point defined by the end of a light collecting member such as an optical fiber 166. In such embodiments, the end of the fiber optic cable 166 is secured to the free end of a relatively rigid supporting pin 112 to act as a sight point 126. Since the optical fiber 166 collects light along its length, to maximize the brightness of the sight point, it is desired to provide an increased length of optical fiber 166. To increase the length of optical fiber 166, the optical fiber 166 extends downwardly from the sight point 126 along the back side of the pin 112 and is wrapped multiple times about the exterior of the hub 168. FIG. 5 schematically shows the optical fiber 166 wrapped about the hub 168. A transparent protective sleeve (not shown) can be mounted over the hub 168 to hold the wraps of optical fiber in place. A weight 190 can also be attached to the hub to enhance pivoting of the second frame member 134.

The sight can also include a slide arrangement 170 supported on the second frame member 134. The slide arrangement 170 includes a block 174 slidably mounted within a track 171 that extends in a front-to-back direction. The pin 112 is mounted to the block 174 such that the front-to-back position of the pin 112 can be adjusted by sliding the block 174 forwardly or rearwardly within the track 171. A first set screw 172 (see FIG. 9) is used to clamp the block 174 at a desired front-to-back position along the track 171. The set screw 172 extends through a front-to-back extending slot 173 in a first side wall of the track 171 and is threaded in a tapped hole within the block 174. By tightening the set screw 172, the block 174 is clamped against the first side wall of the track to secure the block at the desired position along the length of the track 171. In the event the hub 168 is used as a wrap to increase sight point brightness, slack fiber can be provided between the hub 168 and the pin to accommodate movement of the block 174. Alternatively, the hub 168 can be configured to move with the block.

The block 174 can be also constructed to receive a second set screw 175 (see FIG. 9) for engaging the base of the pin 112 for setting the transverse height position of the pin 112. The set screw 175 is threaded within a tapped hole defined by the block 174. The head of the screw 174 is positioned within a front-to-back slot defined by a second side wall of the track 171. By tightening the screw 175, the pin 112 is clamped in place relative to the block 174 with the sight point at a desired height. By loosening the screw 175, the pin 112 can be raised or lowered relative to the block to adjust the height of the sight point.

The slider arrangement 170 could include many alternative features for enabling the sight pin 112 to be conveniently adjusted along the track 171. For example, the slider arrangement 170 could include a spring loaded mechanism instead of a first set screw 172 so that the sight pin 112 can be adjusted with one's fingers without the need to use any tools.

Alternative mechanisms for setting the transverse height of the pin 112 are also available. For example, the pins 112 can be constructed of multiple parts that telescope to allow for adjustment in the transverse height direction. Also, the pins 112 can be simply bent forward or backwards for the transverse height adjustment. In other embodiments, the pins 112 can be threaded into the block 174 and can be moved upward or downward by twisting the pins 112. Yet in other embodiments the transverse height of the pin 112 can be adjusted by moving the entire sight using a gear mechanisms such as the type disclosed in U.S. patent application Ser. No. 10/661,918 incorporated herein by reference in its entirety.

The disclosure is also directed to a method of assembling the bow sight 100' that includes at least the steps of providing a lower partial ring 132 and a frame member 114 and coupling the lower partial ring 132 to the frame member 114 such that the lower partial ring 132 and the frame member 114 define an unobstructed sight window and the ring is pivotally movable with respect to the frame.

Support structure 110 may include a dampening system to reduce vibration caused when bowstring 40 is released. An example of a suitable dampening system includes a material that is softer than the material that makes up the part of the bow handle 25 to which the device is directly attached, such that the dampening system at least partially absorbs the vibrations caused by the release of bowstring 40 when shooting an arrow. Dampening systems are described, for example, in U.S. Pat. No. 6,418,633, which is incorporated herein by reference.

The materials for bow sight 100 can include metals (e.g., aluminum, steel, brass), plastics (e.g., polycarbonate, acrylics), and ceramics and composite materials. Such materials can be used for any of support structure 110, mounting bracket 115, sight window 130, and any other portion of bow sight 100. Pins 120 are preferably a rigid material, such as metal. Any or all of these pieces may include a coating thereon.

In the depicted embodiment, the rings have generally circular shapes. However, as defined herein, the term "ring" is not limited to circular shapes. To the contrary, square rings, oval rings, and other shapes suitable for framing a target viewing opening are included within the definition of ring. The term "viewing opening" includes fully enclosed openings as well as partially enclosed openings such as U-shaped openings (e.g., openings with closed bottoms and sides and opened tops) as well as other partially enclosed openings. As used herein, a full ring means a ring that forms an endless boundary about the target viewing opening 116. A substantially full ring means a ring that forms a boundary that surrounds at least 75% of the target viewing opening 116. A partial ring means a member that forms a boundary that surrounds less than 75% of the target viewing opening 116. A "half ring" means a member that forms a boundary that surrounds approximately 50% of the target viewing opening 116.

Structures through which a target can be viewed can be referred to as target viewing channels, sighting openings, sight windows, or like terms. Structures for supporting a sight pin, such as the lower partial ring 132, can be referred to as pin supports, pin support members, sight point supports or sight pin support members. Structures capable of swinging about a pivot can be referred to as pivot members, pendulum members, pendulums, or like terms. Structures capable of protecting pins can be referred to as cages, protective members, shielding members or like terms.

The above specification and examples provide a complete description of the manufacture and use of the invention. It is to be understood that other embodiments may be utilized and structural changes may be made without departing from the present invention. Although a bow sight has been described, the details of this invention can be incorporated into other projecting shooting applications and systems, such as sights for rifles and shotguns. Since many embodiments of the invention can be made without departing from the spirit and scope of the invention, the invention resides in the claims hereinafter appended.

What is claimed is:

1. A method of targeting comprising:

providing a pendulum member on a bow and a sight point carried by the pendulum member;

sighting in the sight by moving the sight point relative to the pendulum member in an orientation towards or away from the shooter without changing the sight point transverse height relative to the pendulum member.

2. The method of claim 1, wherein the sight point is supported by a sight pin.

3. The method of claim 2, wherein the sight pin is a vertical sight pin.

4. The method of claim 2, wherein the sight point is supported in a track constructed to support the sight pin at a plurality of different positions from the shooter.

5. The method of claim 2, further comprising setting the transverse height of the sight point by bending the sight pin.

6. The method of claim 1, further comprising providing gears for moving the sight point.

7. The method of claim 1, further comprising providing a weight connected to the pendulum for balancing the pendulum about a pivot axis.

8. The method of claim 1, further comprising providing a plurality of sight points supported by a plurality of sight pins.

9. The method of claim 1, wherein the sight point comprises fiber optic material.

10. The method of claim 1, wherein the pendulum pivots away from the shooter when the bow is aimed downwardly.

11. A bow sight comprising:

a sight point; and a sight point support structure connected to the sight point, wherein the sight point support structure includes a pendulum portion, wherein the sight point can be moved to different locations on the pendulum portion, wherein the different locations are positioned along a sight line which extends from a shooter's eye to a target in an orientation towards or away from the shooter, and wherein the pendulum portion is constructed to automatically raise the position of the sight point when the bow is aimed at a target located below the shooter.

12. The bow sight of claim 11, wherein the sight point is supported by a sight pin.

13. The bow sight of claim 12, wherein the sight pin is a vertical sight pin.

14. The bow sight of claim 11, wherein the pendulum portion that is constructed to automatically adjust the position of the sight point is balanced about a pivot axis.

15. The bow sight of claim 11, wherein the bow sight further comprises a plurality of sight points supported by a plurality of sight pins.

16. The bow sight of claim 11, wherein the sight point comprises a fiber optic material.

17. The bow sight of claim 11, wherein the pendulum portion that is constructed to automatically adjust the position of the sight point pivots away from the shooter when the bow is aimed at a downward trajectory.

18. The bow sight of claim 11, wherein the sight point support structure comprises a track for slidably supporting the sight pin.

19. A method of targeting a bow having a bow sight mounted thereon, the bow sight including a pendulum member and supporting a sight point, the method comprising:

sighting the bow for a first target by setting a transverse height position of the sight point relative to the pendulum member; and sighting the bow for a second target by moving the sight point relative to the pendulum member while maintaining the transverse height position of the sight point.

20. The method of claim 19, wherein sighting the bow for the second target includes moving the sight point in a direction towards or away from the target.

21. The method of claim 19, wherein the sight point is provided on a pendulum bow sight attached to the bow.

22. A bow sight for use with a bow comprising:

a sight point that is carried by a member that is pivotally connectable to the bow; and a means for moving the sight point relative to the member in an orientation towards or away from a shooter while maintaining a transverse height position of the sight point.

* * * * *